United States Patent [19]

Kim

[11] Patent Number: 5,029,294

[45] Date of Patent: Jul. 2, 1991

[54] SENSOR UNIT FOR TRAFFIC CONTROL OF AN AUTOMATIC GUIDED VEHICLE

[75] Inventor: Chang S. Kim, Kyungki, Rep. of Korea

[73] Assignee: Samsung Electronics Co., Ltd., Kyongki, Rep. of Korea

[21] Appl. No.: 367,639

[22] Filed: Jun. 19, 1989

[30] Foreign Application Priority Data

Jun. 17, 1988 [KR] Rep. of Korea ..... 88-7308

[51] Int. Cl.[5] ..... G08G 1/123

[52] U.S. Cl. ..... 340/988; 180/168; 246/127 R; 246/187 B; 318/587; 364/436

[58] Field of Search ..... 340/907, 933, 988; 246/122 R, 187 B, 5, 63 A, 167 R; 318/587; 180/168; 364/436, 426 A, 426.05

[56] References Cited

U.S. PATENT DOCUMENTS

| | | | |
|---|---|---|---|
| 3,440,600 | 4/1969 | Frech et al. | 340/988 |
| 3,888,437 | 6/1975 | Birkin | 246/122 R |
| 3,937,432 | 2/1976 | Birkin | 246/187 B |
| 4,027,840 | 6/1977 | Blair | 340/988 |
| 4,284,160 | 8/1981 | DeLiban et al. | 318/587 |
| 4,379,497 | 4/1983 | Hainsworth et al. | 318/587 |

*Primary Examiner*—Joseph A. Orsino
*Assistant Examiner*—Brent A. Swarthout
*Attorney, Agent, or Firm*—Sterne, Kessler, Goldstein & Fox

[57] ABSTRACT

A sensor unit for traffic control of an automatic guided vehicle. Traffic sensor means generates a signal of a specified frequency. Control means controls the direction of the automatic guided vehicle as a function of signal generated by the traffic sensor means. Control sensor means coupled with the traffic sensor means and the direction controlling means sends a stop signal to one or more of the vehicles to resolve conflicts at intersections and avoid collisions and deadlocking.

4 Claims, 12 Drawing Sheets

SENSOR UNIT FOR TRAFFIC CONTROL OF AN AUTOMATIC GUIDED VEHICLE

BACKGROUND OF THE INVENTION

This invention is concerned with an automatic guide system which manages multiple automatic guided vehicles (AGV's).

This invention especially relates to the sensor unit for traffic control that is capable of controlling the transit, stop or deadlocking status of each AGV according to the transit priority of each AGV and to detect the transit direction of an AGV in a traffic control area where the AGV is in danger of crashing into another AGV.

In the automatic guide system which manages the operation of multiple AGV's, a traffic control method is always necessary.

The two methods of communication between the AGV and the control system are point-to-point methods and space communication methods. The space communication method is often used. As in conventional space communication methods, the devices exchange information by using Phase Shift Keying (PSK). It is, however, difficult to implement PSK in an AGV system when the controller is driven by a Programmable Logic Controller (PLC).

On the other hand, the point to point method which communicates by using Frequency Shift Keying (FSK) and controls the AGV's running direction thereby, has had the problems that the capacity of the oscillator becomes bulky, and the hardware to select an operating frequency has to exist in each AGV. It is the object of this invention to solve these conventional problems.

SUMMARY OF THE PRESENT INVENTION

According to the present invention, a traffic control sensor unit which can work regardless of the transit control method of AGV, namely microwave inductive type, optical tape reflective type or ferrite sensing type, is provided so as to sense the transit direction of every element where the AGV needs traffic control and generates the stop signal at the AGV, discriminating the information which is inputted from each control position.

To accomplish this purpose, a traffic sensor unit is set up at each AGV. The traffic sensor unit transmits a frequency according to the transit direction. A control sensor unit is set up on the transit route which generates an output signal corresponding to the selected frequency received from the AGV, and then transmits an assigned frequency to that AGV.

DRAWING REFERENCE NUMERALS

11–14: Detecting elements of the filter or level (selecting elements for receiving frequency)
21–23: Oscillators
OP1–OP10: Operational amplifiers
G1–G6: Logic gates
TR1–TR4: Transformers
VRD: Symmetric zener diode
PC1–PC2: Photocouplers
DEC: Decoder
B1–B3: Buffers

DETAILED DESCRIPTION OF THE PRESENT INVENTION

The present traffic control sensor invention is composed of two unique transceiver units: a control sensor unit 100 and a traffic sensor unit 200. Both sensors are in communication with a controller 300. The controller 300 manages the trafficking of the AGV's. A control sensor unit 100 is located at each intersection or crossing which requires traffic control. The control sensor unit 100 receives the transit direction information which is transmitted from the traffic sensor unit 200 and outputs it to the controller 300. The control sensor unit 100 may then transmit a stop signal to the AGV if instructed to do so by the controller 300.

Figure 1:
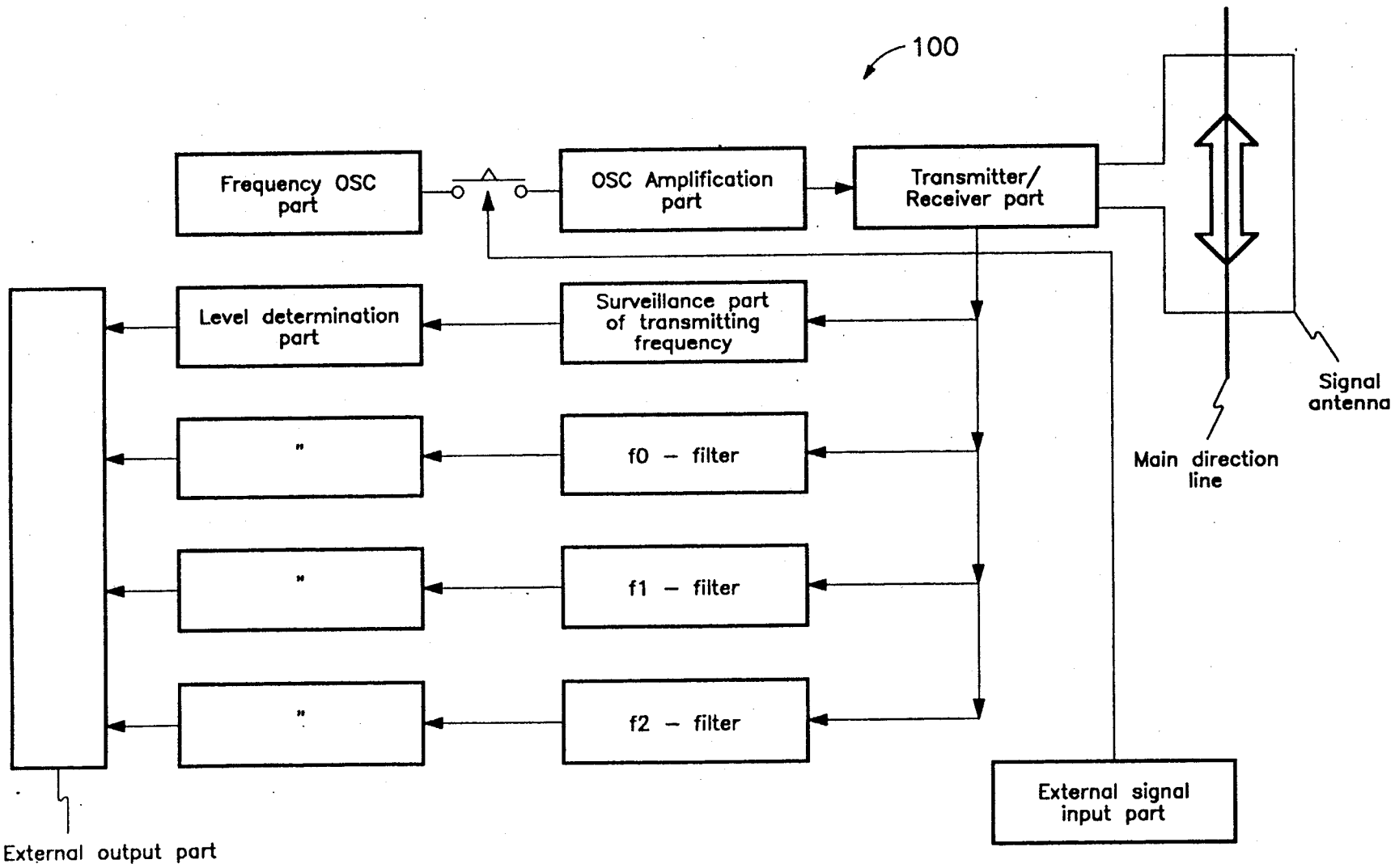
FIG. 1 is a block diagram of the control sensor unit.
Figure 2:
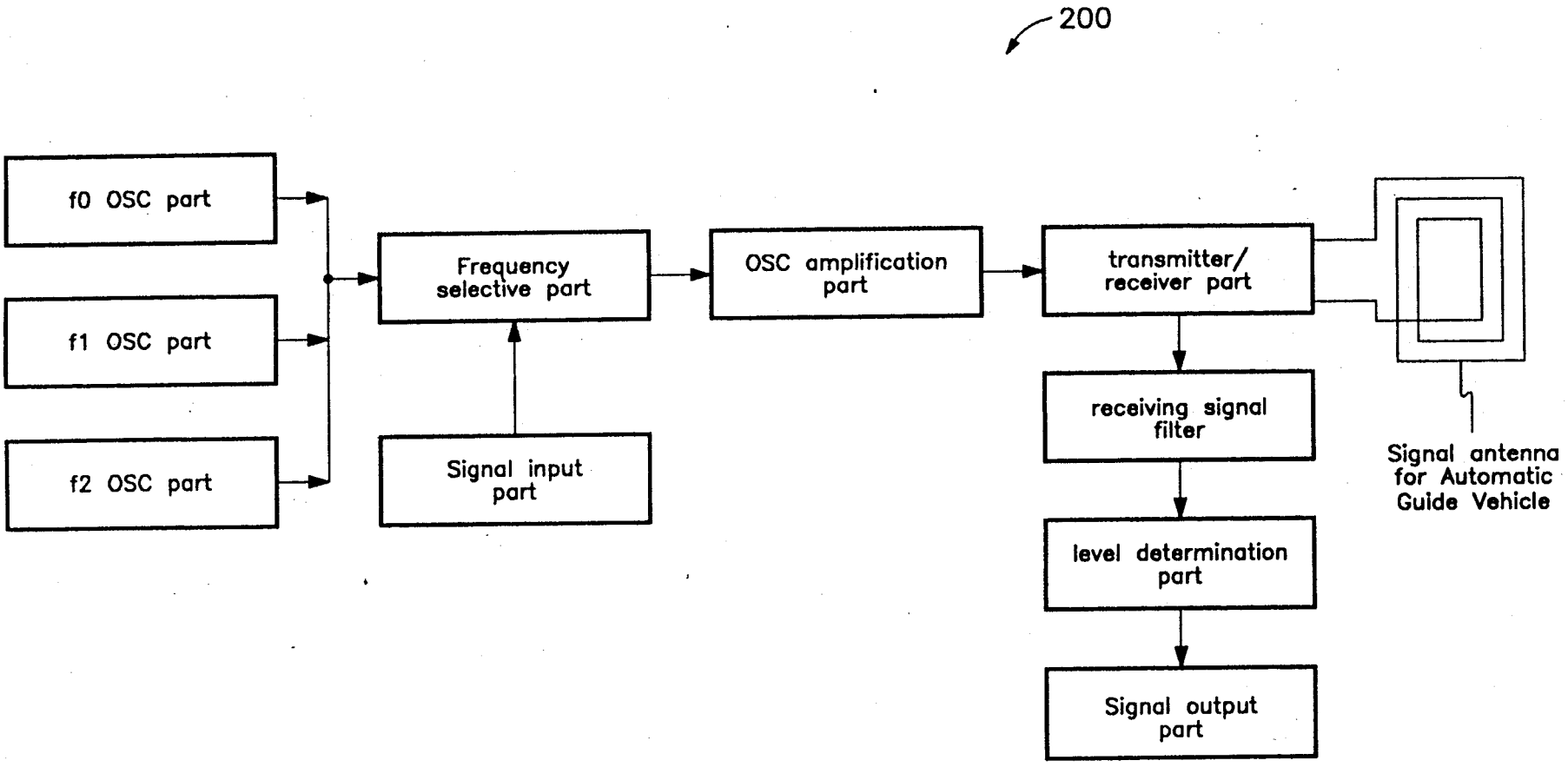
FIG. 2 is a block diagram of the traffic sensor unit for the AGV.

The traffic sensor unit 200 transmits transit direction information for the AGV to the control sensor unit 100. In addition, the traffic sensor unit 200 is capable of receiving a STOP signal from the control sensor unit 100. If received, the STOP signal is passed on to the controller 300 to achieve a halting of the AGV's movement. FIG. 1 is a block diagram of the control sensor unit 100 and FIG. 2 is a block diagram of the traffic sensor unit 200.

Figure 3:
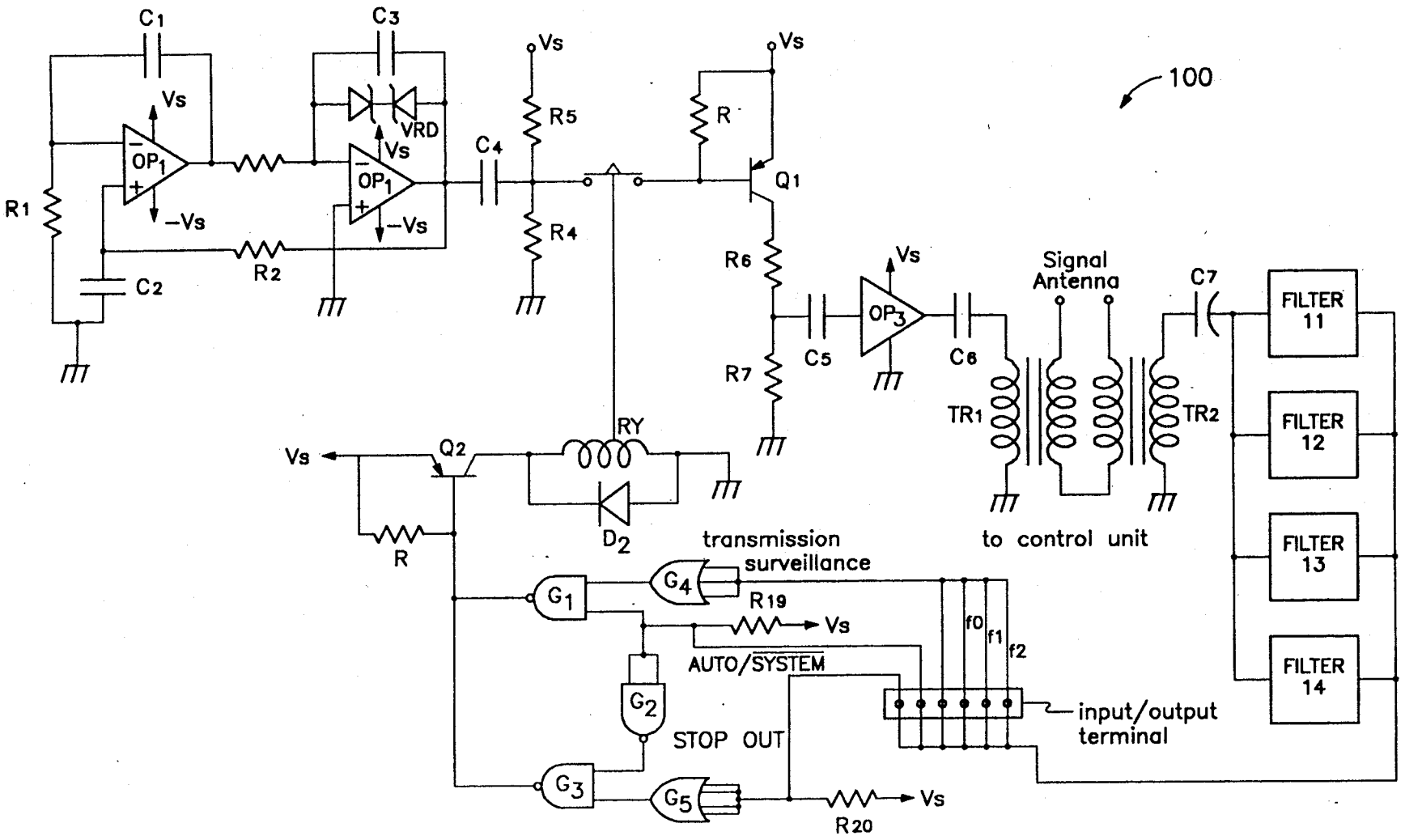
FIG. 3 is a detailed circuit diagram of the control sensor unit of FIG. 1.

FIG. 3 is a detailed circuit diagram of the control sensor unit of FIG. 1 which is structured as follows. As connected, operational amplifiers OP1 and OP2 in conjunction with passive components, resistors R1 and R2, capacitors C1 and C2, and symmetric zener diode VRD form an oscillator which produces the STOP signal. The output of the oscillator is mediated by relay RY. When the contacts of RY are closed, the AC signal is amplified by transistor Q1 and fed through to operational amplifier OP3. The output of OP3 is fed to the primary winding of transformer TR1. The AC signal on the primary of TR1 induces a similar signal in the secondary winding of TR1 which is connected to the signal antenna 400. When the contacts of RY are open, Q1 is biased off and no signal is transmitted by the signal antenna 400.

The primary winding of transformer TR2 is connected in series with the secondary winding of TR1 and the signal antenna 400. When the signal antenna 400 is acting as a receiver, incoming signals are induced in the secondary winding of TR2. That winding then feeds four parallelly connected filter and level-detecting parts 11–14.

Figure 5A:
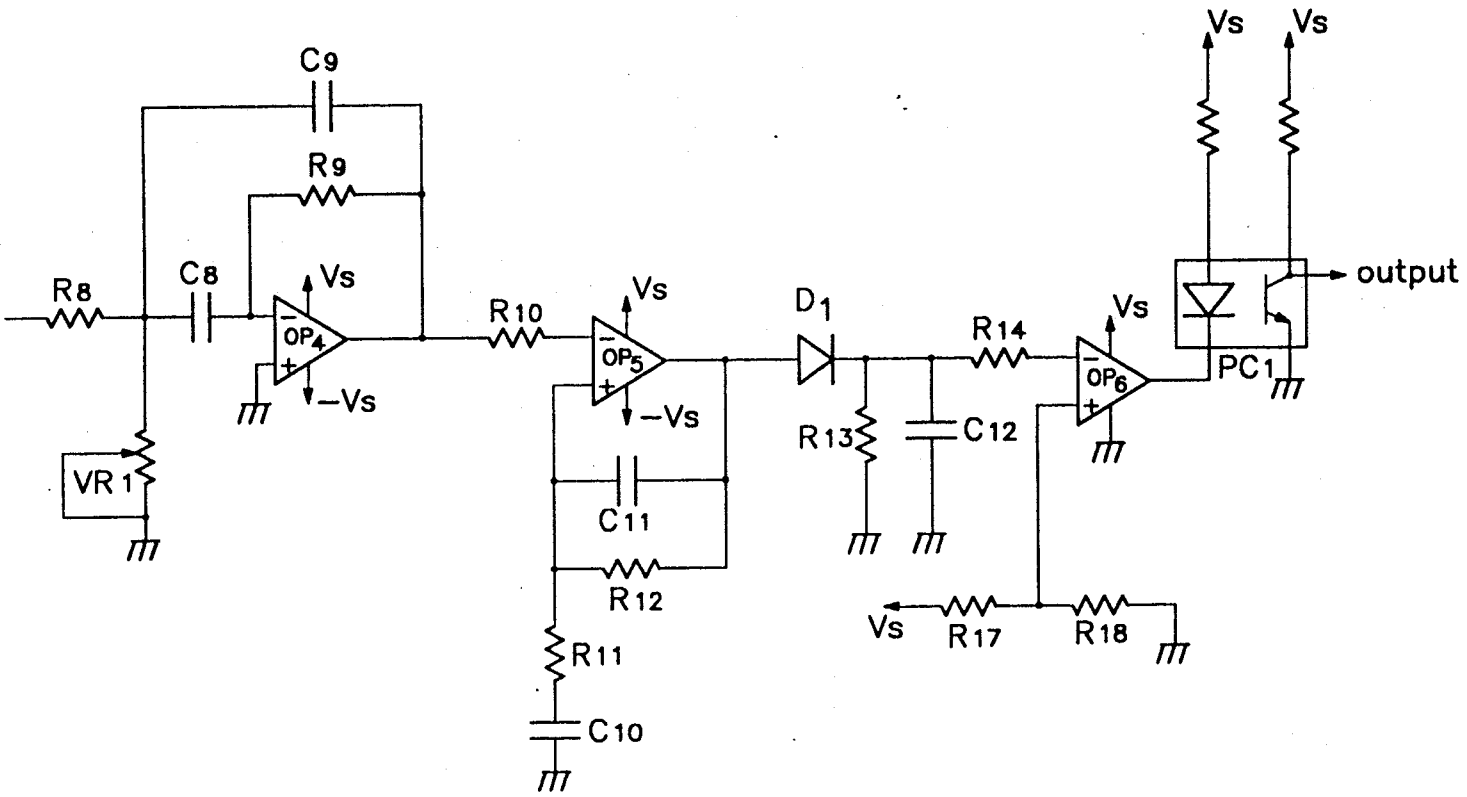
FIGS. 5(*a*) and (*b*) are partially detailed schematics of FIGS. 3 and 4.
Figure 5B:
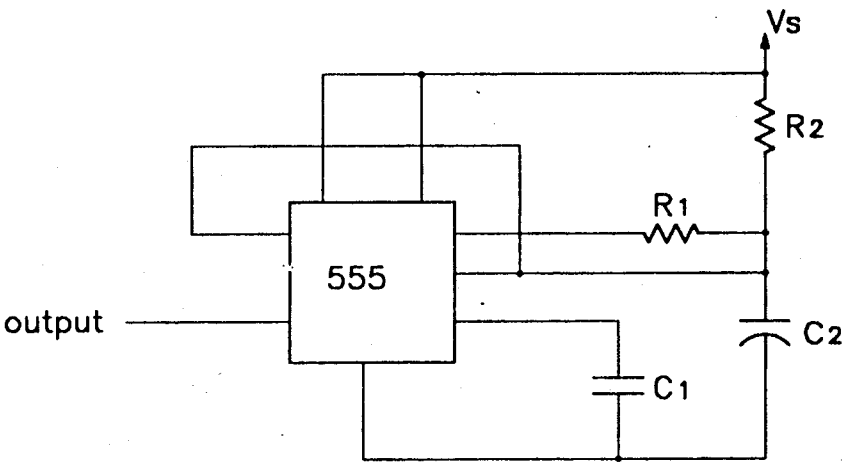

FIG. 5(*a*) is a detailed circuit diagram of the filter and level-detecting parts 11–14 of FIG. 3. Each circuit 11–14 which is connected to the secondary winding of TR2 is a frequency adjustable selective-pass filter. Frequency adjustment element, variable resistor VR1, is connected to the inverting input of operational amplifier OP4 which is configured with passive components, resistors R8 and R9 and capacitors C8 and C9, to form a tunable filter. The output of OP4 is fed into the operational amplifier OP5 which is configured with passive components to form a band-pass filter. The band-pass function is achieved through the combination of filter elements R11 and C10 and filter elements R12 and C11. The filtered AC output signal of OP5 is rectified by diode D1 and smoothed by filtering elements, resistor R13 and capacitor C12, so that a DC voltage is applied to the inverting input of comparator OP6. The non-inverting input of OP6 is held at a reference level by the voltage divider formed by resistors R17 and R18. The output of OP6 is connected to a photocoupler PC1 which generates the output for the level detecting part.

Referring back to FIG. 3, the coil of relay RY is energized by transistor Q2. RY is a non-latching type relay which only latches when a current is passed through its coil. Q2 will conduct and energize RY when either NAND gate G1 or G3 goes to a low state. G1 will be low when the output of OR gate G4 is high and the AUTO/SYSTEM terminal line which is connected to pull-up resistor R19 from the input/output terminal 500 is also high. The output of the OR gate G4 will be high when any one of the level detector parts 11–14 is high. The AUTO/SYSTEM terminal line is a control line from the controller 300.

NAND gate G3 will be in a low state when the AUTO/SYSTEM terminal line is low and the output of OR gate G5 is high. G5 will be high when the STOP OUT signal is high.

Figure 4:
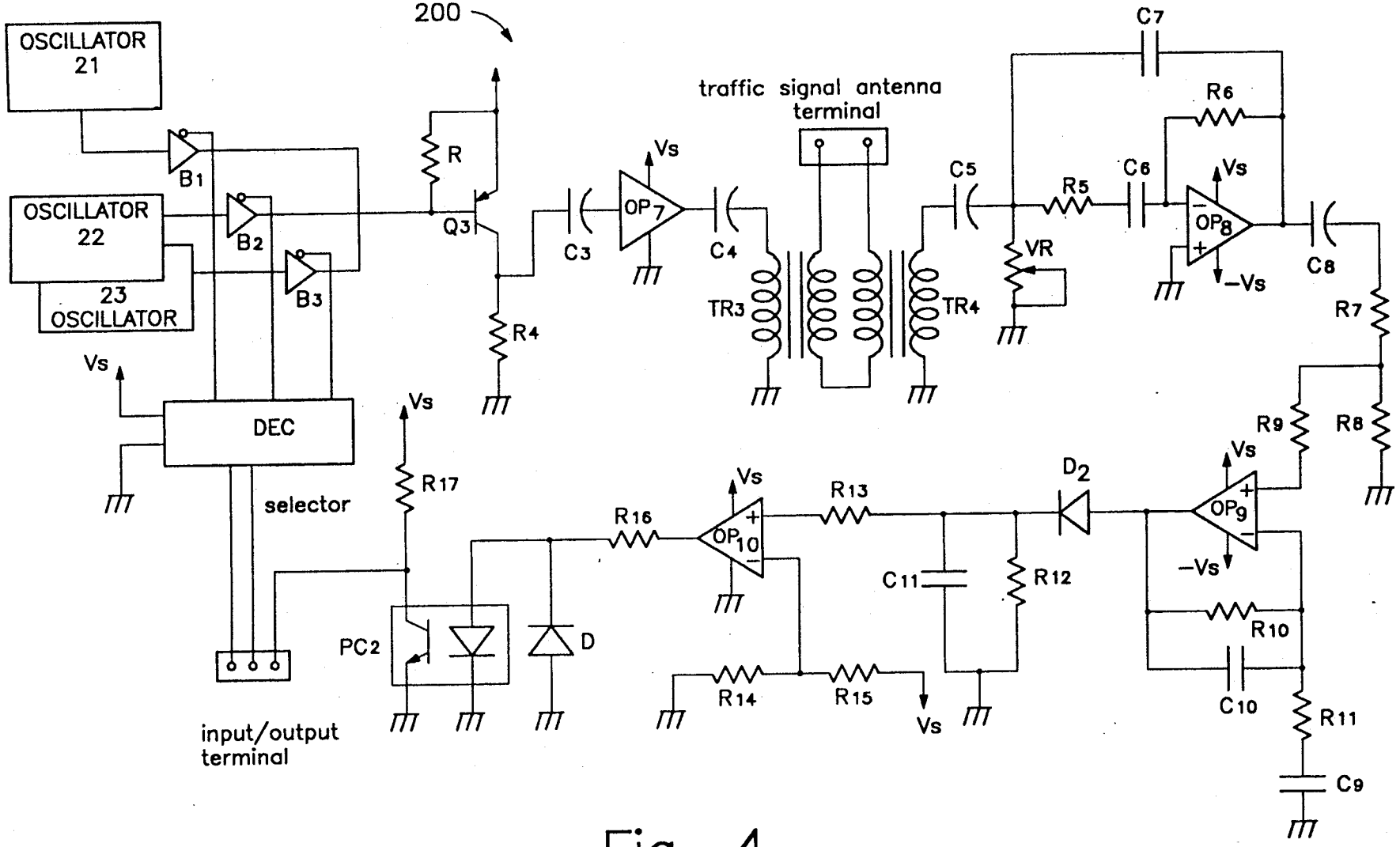
FIG. 4 is a detailed circuit diagram of the traffic sensor unit of FIG. 2.

FIG. 4 is a detailed circuit of the traffic sensor unit 200 of FIG. 2. The oscillators 21–23 produce a 50% duty cycle frequency. Each oscillator produces a signal of unique frequency, each corresponding to a different transit signal. One frequency corresponds to "turn right", a second to "turn left" and the final one to "straight". The values of the passive elements R1, R2, C1, and C2 of the oscillating circuit 21–23 define its frequency of oscillation. Each signal comes out of oscillator 21–23 and is applied to the base of transistor Q3 through a tri-state buffer B1–B3. Only one buffer at a time will pass the signal from its oscillator. Q3 amplifies the signal as it passes to operational amplifier OP7. The output of OP7 is then connected to the primary winding of transformer TR3.

The signal acting on the primary of TR3 induces a signal on the secondary winding, which is connected to the traffic signal antenna 700 for transmission to the control sensor unit 100.

The primary winding of transformer TR4 is connected in series with the secondary winding of TR3 and the traffic signal antenna 700. When the traffic signal antenna 700 is acting as a receiver, incoming signals are induced in the secondary winding of TR4. That winding feeds an input/output terminal 600 via a filter and level-detecting circuit similar to that discussed above in reference to 11–14 of FIG. 3 comprising a multi-pass filter OP8, a band-pass filter OP9, a comparator OP10, a rectifier with a filter, and a photocoupler.

A signal entering from the input/output terminal 600 is inputted to decoder DEC. The output signal from DEC is inputted to the control terminals of buffers B1–B3 to control the selection of the signal from the oscillators 21–23 which is inputted to the base of transistor Q3.

A detailed circuit of the oscillator of 21–23 in FIG. 4 is represented in FIG. 5(*b*).

Figure 6:
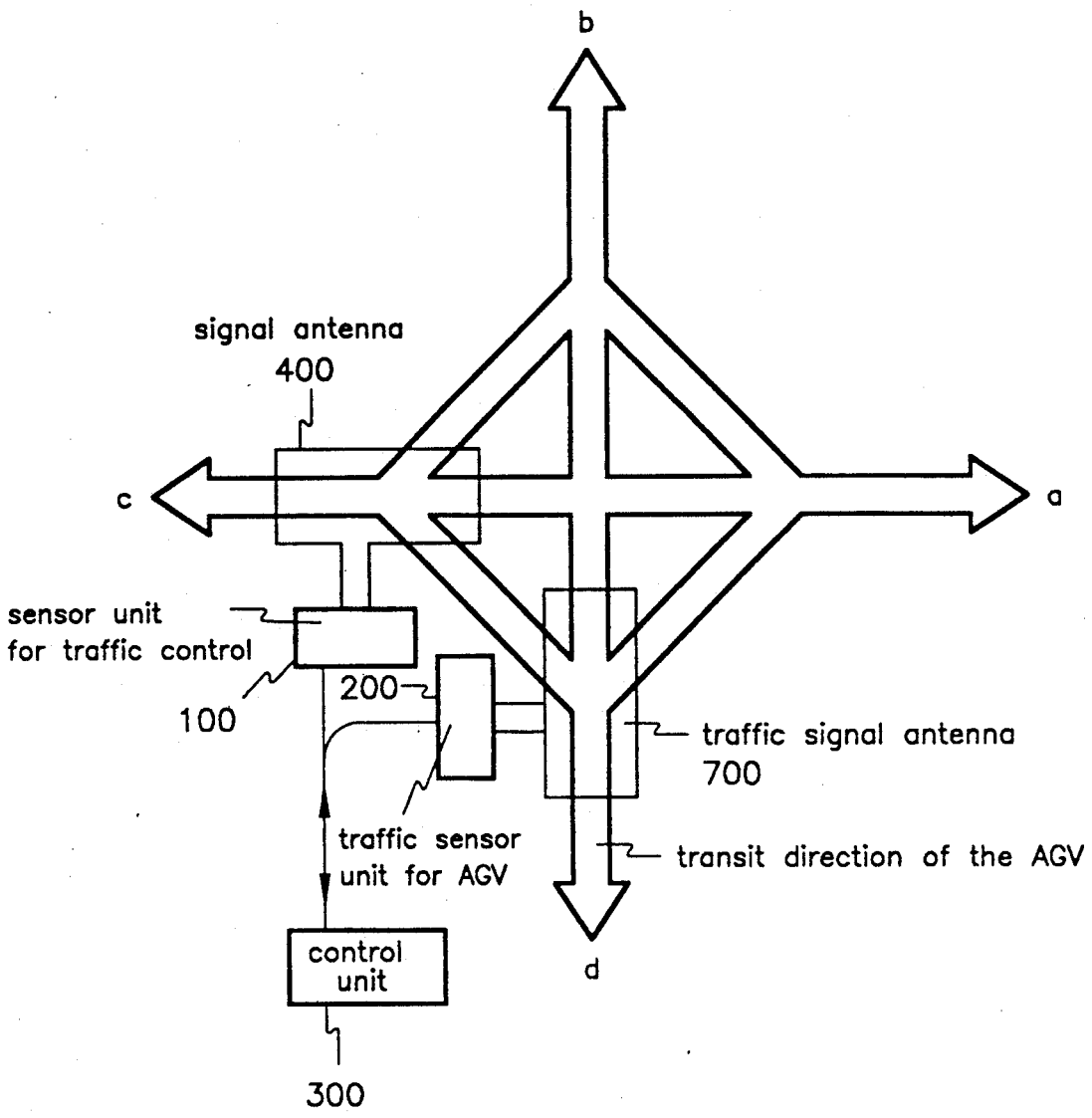
FIG. 6 is a layout for a transit control of an AGV.
Figure 7:
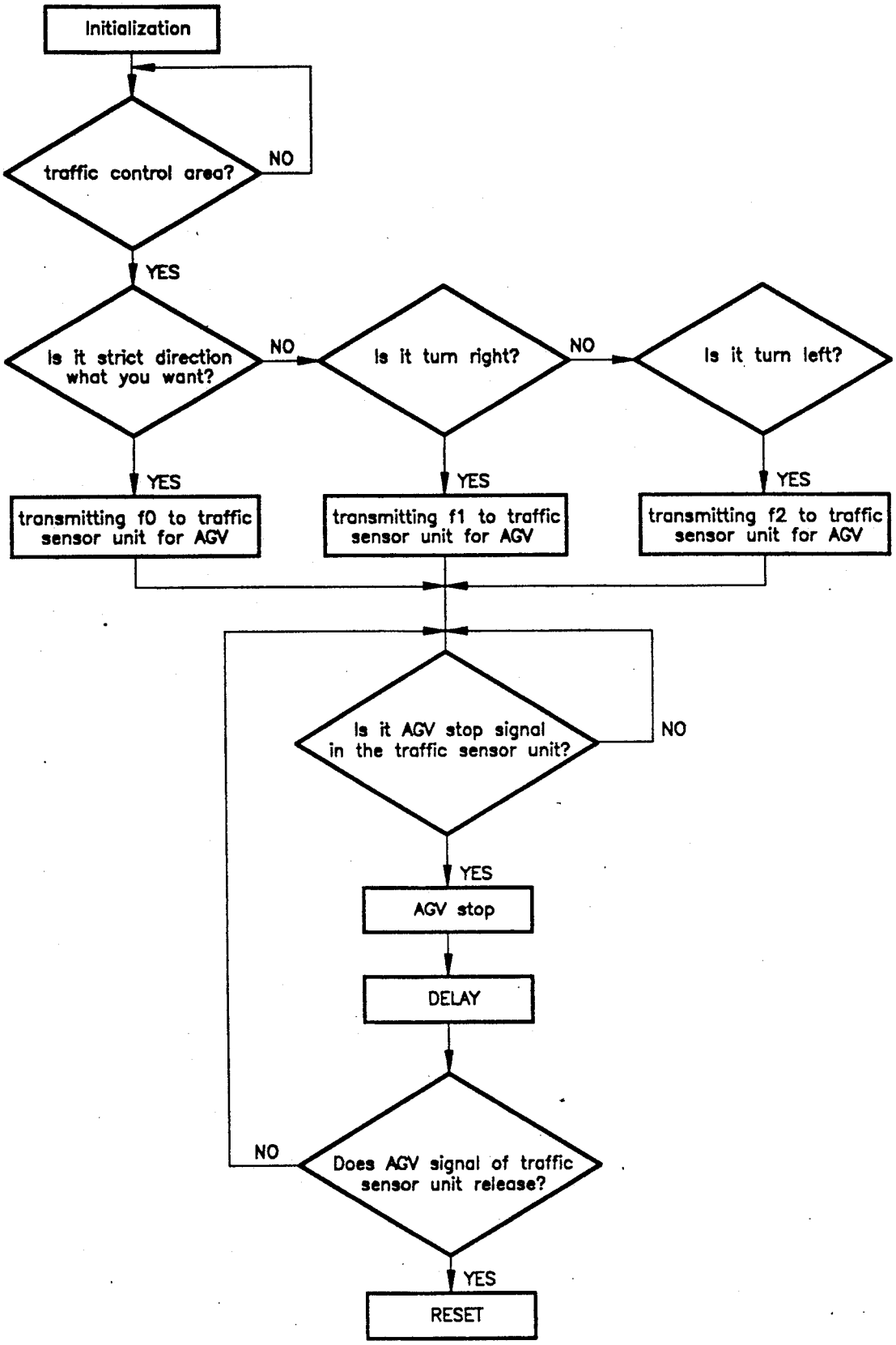
FIG. 7 is a flow chart for control of an AGV.
Figure 8:
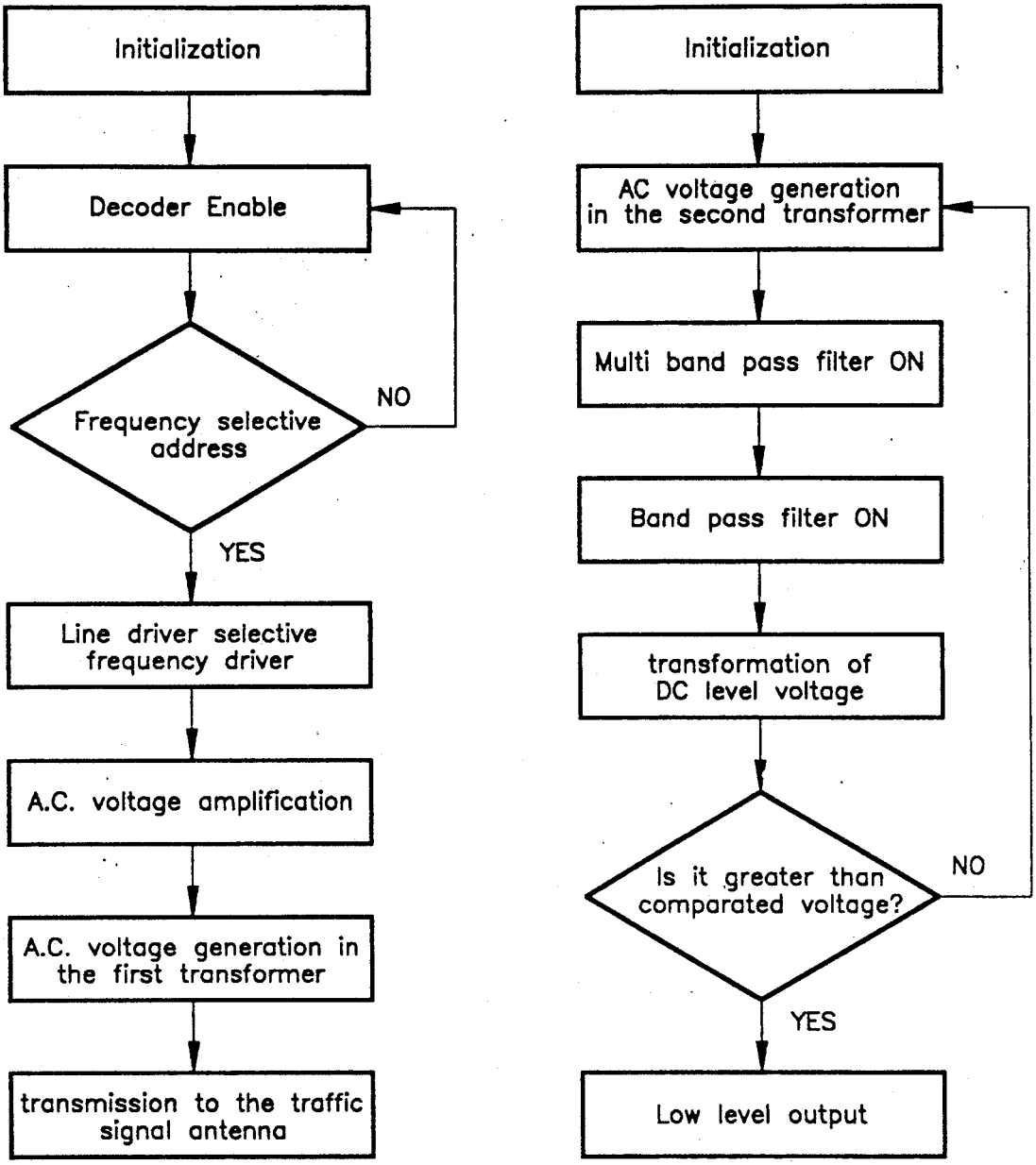
FIG. 8 is a flow chart for the hardware of an AGV.
Figure 9:
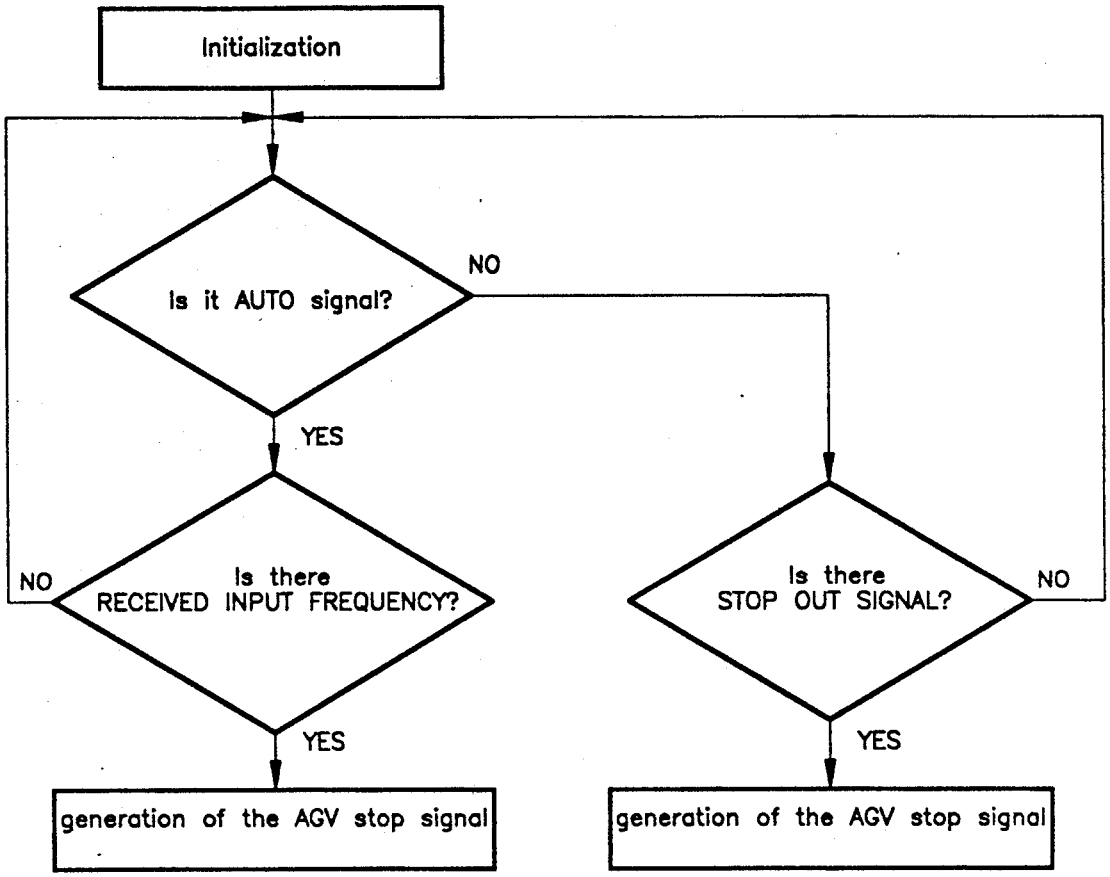
FIG. 9 is a flow chart of the control sensor unit.

FIG. 6 details the transit control of an AGV control system embodying the novel sensor unit of the present invention. This is further explained by the detailed flow charts of FIGS. 7 and 9.

To control the transit of an AGV in the automatic delivery system that uses automatic guided vehicles according to FIG. 6, the AGV travelling in the a–d direction orders the AGV's from each side to turn right or left and to proceed forward through the instersection equipped with traffic signal antenna 700; each intersection is equipped with a traffic signal antenna 700.

Furthermore, the control unit makes an AGV stop or run continuously without any dead locking and works to judge the situation in case any dead locking occurs. Accordingly, an AGV must receive an order regarding the transit direction from the controller 300 through the traffic signal antenna 700 and the controller 300 needs to stop or start the AGV according to the transit condition that is inputted to the control sensor unit 100 from the traffic signal antenna 700 facilitated at a and d sides respectively. Therefore, an AGV has to receive the preceding information with the indicated frequency in a traffic control district and to convey a STOP signal to the traffic sensor unit 200 by perceiving it with the traffic signal antenna 700.

The following explanations concern the principles of operation of the sending and receiving mode in the control sensor unit 100 (A) and of the sending and receiving mode in the traffic sensor unit 200 (B).

A. The Operative Principles of the Control Sensor Unit

1. The Transmission Mode

The STOP signal of an AGV is produced by the oscillator circuit of OP1 and OP2 of FIG. 3. The oscillator output is controlled by relay RY. When the contacts of RY are open, transistor Q1 is biased off and thereby, the AC signal of the oscillator is not transmitted.

But when the contacts of RY are open, the AC signal is inputted from the oscillator circuit to the operational amplifier OP3 and then stepped up in voltage by transformer TR1. Thereupon, the AC signal reaches the signal antenna 400 for transmission.

The contact position of RY is controlled by the STOP OUT signal, the AUTO/SYSTEM signal, and the transit signals received from the traffic sensor units 200.

2. The Receiving Mode

An AC signal from the signal antenna 400 passes through the primary winding of transformer TR2 and induces a similar signal in the secondary winding of TR2.

The frequency selected by a variable resistor VR1 in one of the filter and level-detecting parts 11–14 is amplified by the multi-pass filter made up op amp OP4 and through the band-pass filter formed by op amp OP5. The AC signal is then converted to a DC voltage level by rectifying and filtering.

This DC voltage is then compared to the reference voltage applied to the non-inverting input of the comparator OP6. Comparator OP6 outputs a low signal when the voltage level from the rectified signal is greater than the reference level set by R17 and R18. This low causes the photocoupler to output a low. Thus, a low output from the level detecting part corresponds to the presence of a signal of an assigned frequency at its input.

Each output line from the filter and level-detecting parts 11–14 is output to the upper control decision part. Three outputs are input to OR gate C4. The supervisory receiving output goes to the controller 300. The AUTO/SYSTEM terminal, which is an external control terminal, is pulled-up and input to NAND gates G1 and G2. When the external control terminal opens or goes high, and there is no assigned frequency present to cause the filter and level-detecting parts 11–14 to go low, NAND gate G1 will output a low in order to turn Q2 on to close the contacts of relay RY and transmit the AGV STOP signal.

If the external control terminal AUTO/SYSTEM is set low, NAND gate G1 output is set high and does not drive transistor Q2. AUTO/SYSTEM low, however, allows the STOP OUT terminal to generate the STOP signal when it is high.

B. The Operative Principles of the Traffic Sensor Unit

1. The Transmission Mode

Reference is now made to FIG. 4. The traffic sensor unit 200 contains three oscillator circuits. Each has a different frequency of oscillation. The output buffers B1–B3 are controlled by decoder DEC and only one frequency of the three is selected for transmission at a time. If not selected, B1–B3 is holding a high impedance. Accordingly, the transit state of the AGV is represented by the transmitted frequency of one of the oscillators 21–23. The three possible transit states include "turn right", "turn left" and "straight".

2. Receiving Mode

If an AC voltage is induced in the traffic signal antenna 700, a similar signal is induced in the secondary winding of TR4. That winding feeds an input/output terminal 600 via a filter and level-detecting circuit. If a signal of the assigned frequency is received, it will be amplified, filtered, and used to generate a low output to the input/output terminal 600. A signal entering from the input/output terminal 600 controls the decoder DEC. The output signal from DEC is inputted to the control terminals of buffers B1–B3 to control the selection of the signal from the oscillators 21–23.

Figure 10:
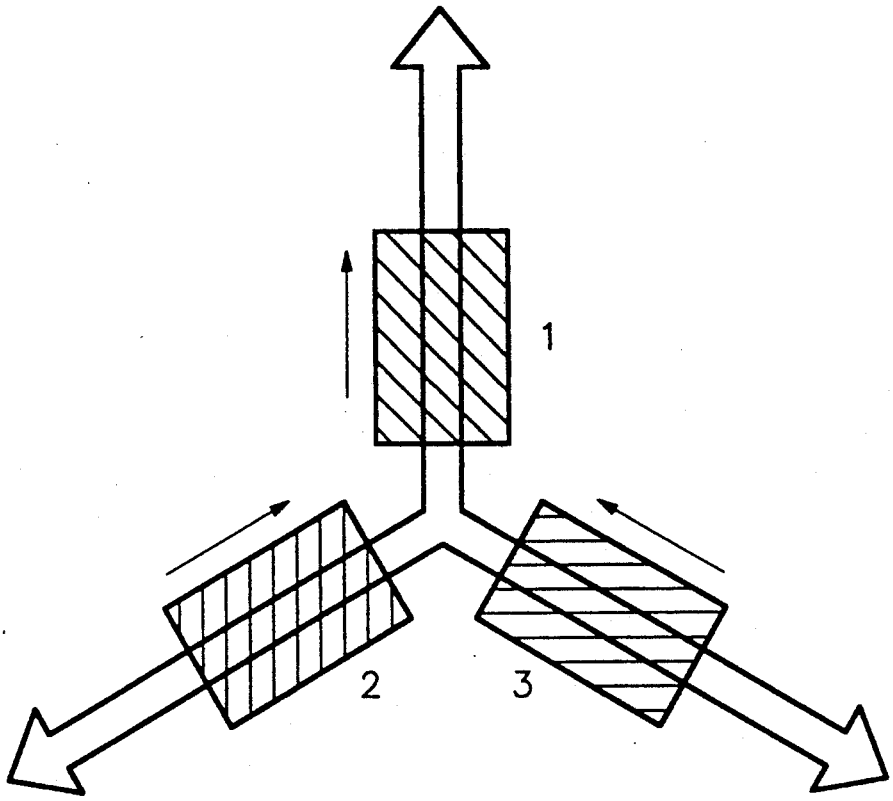
FIG. 10 is a diagram for a traffic control example of an AGV.
Figure 11:
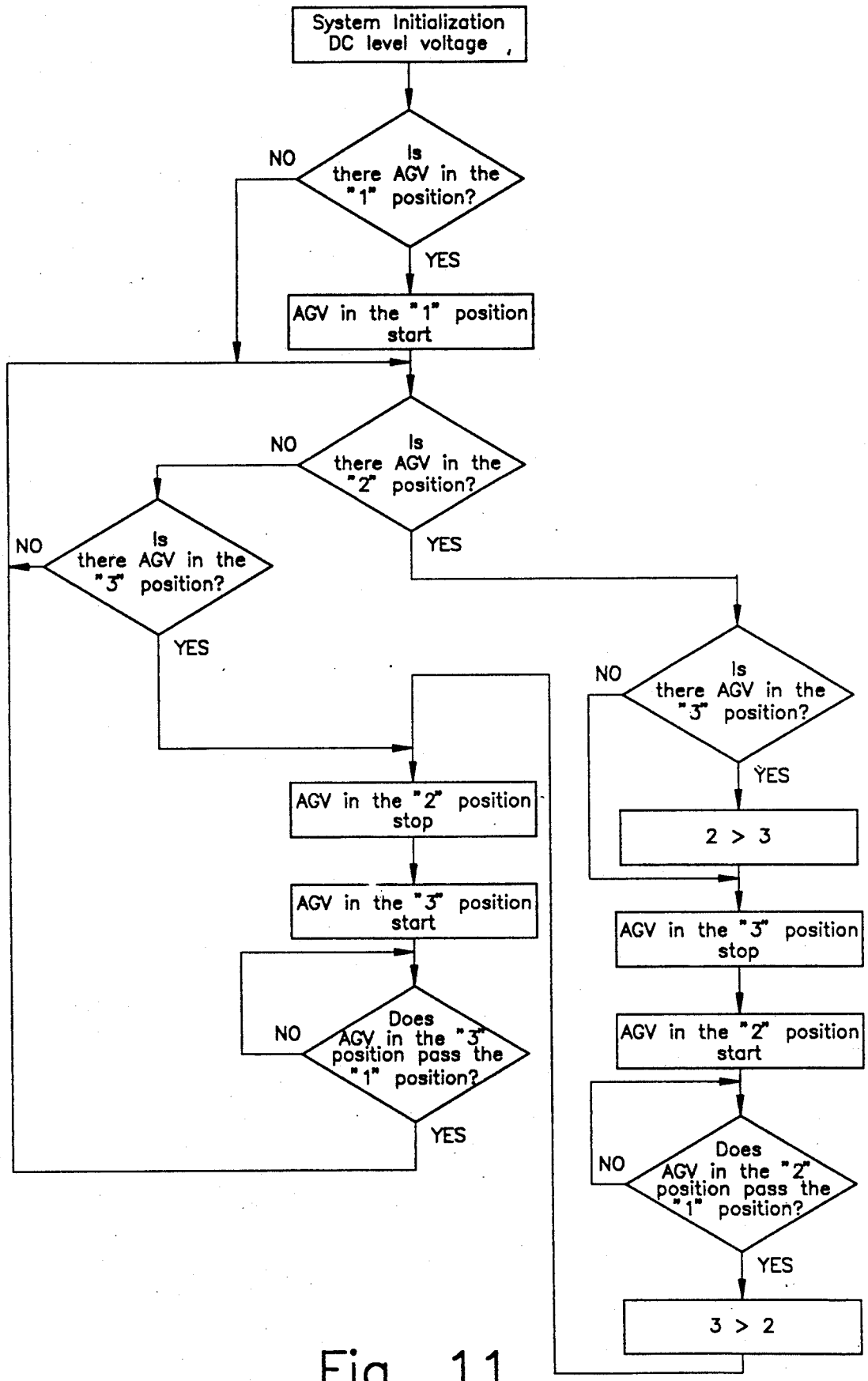
FIG. 11 is a flow chart for the operational example of FIG. 10.

If a low level signal is output, this signal will instruct the controller 300 to stop the AGV at the traffic sensor unit 200. The transit state of any AGV in motion is transferred to the controller 300 by means of the traffic sensor unit 200, the transmitting and receiving sensor unit of the AGV, and the transmitting and receiving action of the control sensor unit 100 on the travelling road, or the AGV is effectively controlled by the control signal of the controller 300. FIG. 10 shows an exemplary embodiment for the traffic control of multiple AGV's. The antennas of the sensor control unit and the traffic sensor unit 200 are shown in FIGS. 10, 1, 2 and 3. FIG. 11 represents the control method of the controller 300.

Traffic control on a join point and a cross point, as shown in the flow chart of FIG. 11, is possible as the controller 300 determines the output information from the control sensor unit 100 by the shared frequency following the straight, turn left, turn right commands which are transmitted by the AGV.

This invention is also useful as input for a controller which opens or closes an automatic door by determining entrance of an AGV or which sequentially operates in the transit of an AGV. As stated, this invention has the output which determines the direction of a vehicle by receiving and transmitting the frequency and sending the specified frequency into the traffic signal antenna 700.

The present invention is economical in that it can be installed and operated regardless of the control method and transit leading method of an AGV by controlling the vehicle through receiving the specified frequency.

This invention also has the merit that it can be used as the sensing unit for an automatic control door which operates by the ascertainment of movement.

What is claimed is:

1. A traffic control system for preventing collisions of automated guided vehicles approaching a traffic intersection, comprising:

(a) a traffic sensor unit located within each automated guided vehicle, said traffic sensor unit comprising:
  a first means for transmitting a first signal indicative of the transmit direction of the corresponding automated guided vehicle, and
  a second means for receiving a stop signal and for halting movement of the corresponding automated guided vehicle;

(b) a controller unit located remote from said traffic sensor unit, said controller unit for managing the trafficking of said automated guided vehicles; and (c) a control sensor unit located at each traffic intersection, each said control sensor unit comprising:
  a third means for receiving said first signal from said traffic sensor unit of the automated guided vehicles;
  a fourth means for transmitting said first signal to said controller unit;
  a fifth means for receiving a signal from said controller unit indicative of a command to generate said stop signal for one or more said automated guided vehicles; and
  a sixth means for generating and transmitting said stop signal to said second means.

2. The traffic control system of claim 1, wherein said third means comprises a transceiver.

3. The traffic control system of claim 2, wherein said fifth means comprises an input/output terminal to electronically connect said control sensor unit to said controller unit.

4. A method in a traffic control system for preventing collisions of automated guided vehicles approaching a traffic intersection, the system comprising a traffic sensor unit located within each automated guided vehicle, said traffic sensor unit having a first means for transmitting a first signal indicative of the transmit direction of the corresponding automated guided vehicle, and a second means for receiving a stop signal and for halting movement of the corresponding automated guided vehicle; a controller unit located remote from said traffic sensor unit and which manages the trafficking of said automated guided vehicles; and a control sensor unit located at each traffic intersection, each said control sensor unit having a third means for receiving said first signal from said traffic sensor unit of the automated guided vehicles; a fourth means for transmitting said first signal to said controller unit; a fifth means for receiving a signal from said controller unit indicative of a command to generate said stop signal for one or more said automated guided vehicles; and a sixth means for generating and transmitting said stop signal to said second means, the method comprising the step of:

(1) transmitting first signals from the automated guided vehicles approaching the traffic intersection to indicate which direction each of said vehicles intends to pursue at said traffic intersection;

(2) receiving said first signals at said control sensor unit;

(3) communicating said first signals to said controller unit from said control sensor unit;

(4) transmitting a command at said controller unit to said control sensor unit to transmit the stop signal to one or more said automated guided vehicles; and (5) transmitting said stop signal at said control sensor unit to said second means.

* * * * *

UNITED STATES PATENT AND TRADEMARK OFFICE

CERTIFICATE OF CORRECTION

PATENT NO. : 5,029,294
DATED : 2 July 1991
INVENTOR(S) : Chang Sub Kim

It is certified that error appears in the above-indentified patent and that said Letters Patent is hereby corrected as shown below:

On the title page: Item

[75] Inventor: change "Chang S. Kim" to -- Chang Sub Kim --:

Signed and Sealed this

Twenty-ninth Day of August, 1995

*Attest:*

Bruce Lehman

BRUCE LEHMAN

*Attesting Officer*

*Commissioner of Patents and Trademarks*